United States Patent [19]

Forbes

[11] Patent Number: 4,968,514

[45] Date of Patent: Nov. 6, 1990

[54] BEER BOTTLE WITH FULLY REACTED THERMOPLASTIC POLYURETHANE CROWN CAPLINER

[75] Inventor: David L. Forbes, Chesterfield, Mo.

[73] Assignee: Forbes Polytech, Inc., Chesterfield, Mo.

[21] Appl. No.: 921,801

[22] Filed: Oct. 20, 1986

Related U.S. Application Data

[63] Continuation of Ser. No. 680,653, Dec. 11, 1984, abandoned.

[51] Int. Cl.[5] ..... B65D 41/20

[52] U.S. Cl. ..... 426/106; 426/397; 426/131; 215/341; 215/352; 215/328

[58] Field of Search ..... 426/106, 397; 215/341, 215/352, 328, DIG. 2, 348, 349

[56] References Cited

U.S. PATENT DOCUMENTS

| | | | |
|---|---|---|---|
| 2,327,454 | 8/1943 | Punte | 215/328 |
| 2,327,455 | 8/1943 | Punte | 215/328 |
| 3,270,904 | 9/1966 | Foster et al. | 215/346 |
| 3,406,854 | 10/1968 | Testa | 215/352 |
| 3,442,411 | 5/1969 | Mahoney | 215/40 |
| 3,446,380 | 5/1969 | Everett | 215/328 |
| 3,497,098 | 2/1970 | Myer | 215/328 |
| 3,520,436 | 7/1970 | Vercillo | 215/348 |
| 3,547,746 | 12/1970 | Gwinner . | |
| 3,563,402 | 2/1971 | Arnold | 215/341 |
| 3,695,477 | 10/1972 | Edmonston et al. | 215/341 |
| 3,799,380 | 3/1974 | Hashimoto et al. | 215/40 |
| 4,093,098 | 6/1978 | Wszolek | 215/349 |
| 4,128,185 | 12/1978 | Wszolek | 215/349 |
| 4,527,705 | 7/1985 | Prades | 215/341 |

FOREIGN PATENT DOCUMENTS

| | | | |
|---|---|---|---|
| 600346 | 6/1960 | Canada | 215/341 |

OTHER PUBLICATIONS

Hardwick, W. A., Packaging Materials and Beer Quality in Beer Packaging: A Manual for the Brewing and Beverage Industries (1982).

Kirk-Othmer, Encyclopedia of Chemical Technology, 3d Edition, vol. 8, pp. 626-640, vol. 10, pp. 216-246, vol. 23, pp. 576-608, no date given.

K. J. Quinn & Co., Inc., Introduction and General Information to Q-Thane Thermoplastic Polyurethane Resins, no date given.

Upjohn Company, Pellethane Processing Guide, no date given.

Upjohn Company, DSG Reports 16, 17 and 20, no date given.

Nippon Elastollan Industries Ltd., Thermoplastic Polyurethane Liberan, no date given.

*Primary Examiner*—Steven Weinstein

*Attorney, Agent, or Firm*—Polster, Polster and Lucchesi

[57] ABSTRACT

A bottle crown cap, particularly for beer bottles, comprising a metal shell and a liner of thermoplastic polyurethane. The liner material is completely reacted, then applied directly to the shell by a hot melt process.

9 Claims, No Drawings

BEER BOTTLE WITH FULLY REACTED THERMOPLASTIC POLYURETHANE CROWN CAPLINER

This is a continuation application of copending application Ser. No. 06/680,653, filed on Dec. 11, 1984, now abandoned.

BACKGROUND OF THE INVENTION

This invention relates to container closures. It has particular application to crown caps for bottles, most especially to beer bottle crowns.

A beer container or package must protect the flavor of the beer during transport and storage of the beer. It must exclude all oxygen. It must not contain any materials which can be extracted by the beer, and conversely it must not scavenge the flavorants naturally occurring in the beer. Although bottled beer has popularly been regarded as well protected, brewers have long known that bottle crowns have not provided altogether adequate protection of the beer. The problem has been found to be largely in the plastic crown liner. A discussion of the problems associated with polymeric packaging materials (including crown liners) in the beer industry is contained in a paper entitled "Packaging Materials and Beer Quality" by Dr. W. A. Hardwick, Jr., appearing as chapter 23 in Beer Packaging: A Manual for the Brewing and Beverage Industries, edited by Harold M. Broderick (Madison, Wisconsin, 1982).

The most common crown liner material is polyvinyl chloride (PVC), containing dioctylphthalate as a plasticizer, and a calcium or zinc stearate antioxidant. This material scavenges some of the flavor-giving esters in beer and frequently contains extractable impurities.

The PVC liner is applied either as a creamy plastisol and spread by spinning or molding, or else by melting a powdered plastisol in an extruder and extruding the molten material into the crown shell. In the latter process, a tamping tool may be used to form the liner. The liner is sometimes applied as a die-cut film and melted to the crown shell in situ. In any of these processes, it is important to control the temperature carefully to drive off all volatile materials without damaging the crown shell or the polymer. The crown liner is sometimes foamed to give it more resilience, but both the foaming agent and the increased surface area of the liner increase the likelihood that the liner will affect the flavor of the beer.

Other crown liners have been used or proposed, but all have similar problems. For example, polyethylene and ethylene vinyl acetate liners have an even greater effect than PVC, by scavenging flavor components from the beer. In U.S. Pat. No. 3,799,380 to Hashimoto et al, a bottle crown liner is formed by reacting, in the crown shell, a polyol and an aromatic isocyanate to form a thermoset polyurethane. This approach requires new equipment to replace the standard PVC liner and requires that the bottle crown manufacturer maintain the highest manufacturing standards to assure complete reaction of the monomers and complete removal of solvents and catalysts. Even when the process is carried out with utmost care, the process generally requires the use of an excess of toxic isocyanates, which are reacted after the main polymerization reaction has been completed. Moreover, a substantial curing period is required, preferably at elevated temperature. The resulting thermoset polyurethane liner may have physical and chemical properties which are not altogether desirable. An earlier patent to Mahoney, No. 3,442,411, discloses a similar approach, with a foamed polyurethane.

SUMMARY OF THE INVENTION

One of the objects of this invention is to provide a bottle crown which provides better flavor protection than crowns known heretofore, particularly when used on beer bottles.

Another object is to provide such a crown whose liner lacks extractable additives and does not scavenge flavor components from beer.

Another object is to provide such a crown which may be manufactured using existing equipment, including extruders.

Another object is to provide such a crown which is easier to assemble and has broader manufacturing parameters, including liner molding temperatures.

Another object is to provide such a crown whose liner has a high degree of memory, and therefore maintains a seal even after it has been compressed for long periods.

Another object is to provide such a crown whose liner is highly adhesive to the crown shell.

Other objects will occur to those skilled in the art in light of the following description and accompanying drawings.

In accordance with one aspect of this invention, generally stated, a container closure is provided which includes a shell and a liner, the liner being formed of thermoplastic polyuretane elastomer. The polyurethanes which are useful in the present invention must be thermoplastic rather than thermosetting, but their exact chemical composition has not been found to be critical to their usefulness in the invention.

The closure shell is made of a material which provides the required strength to hold the closure to the container, and is preferably made of metal. In the preferred embodiments, the closure is a bottle crown cap, most preferably for a beer bottle.

The thermoplastic polyurethane elastomer is applied to the bottle crown shell as a completely reacted polymer, containing neither plasticizer nor non-reacted monomers. The thermoplastic polyurethanes have a wide range of hardness, and do not change that hardness appreciably over a wide temperature range. They have good low temperature flexibility, high abrasion resistance, good elasticity, and good memory properties. Because these outstanding qualities are built into the backbone of the polymer, and are not produced by additives, they remain stable when the liner is exposed to beer or other contents of the container. The thermoplastic polyurethanes are meltable without affecting their chemical properties, and the molten polymer is easily molded. I have found that the materials function well in all respects as crown liners, without requiring the addition of plasticizers, softening agents or antioxidants.

Many of the properties of thermoplastic polyurethanes are well known and are set out, for example, in the Kirk-Othmer Encyclopedia of Chemical Technology, Third Edition, particularly at volume 8, pages 626–40, especially pages 632–35, volume 10, pages 216–246, especially page 232, and volume 23, pages 576–608.

The use of thermoplastic polyurethane elastomers as liners for beer bottle crown caps fills a long-felt need in the beer industry. Probably because of the perceived danger in using a material based on isocyanates and because of the difficulties attendant upon the previously proposed thermoset polyurethanes, the use of thermoplastic polyurethanes as closure liners has not been heretofore proposed. Nonetheless, the thermoplastic polyurethane elastomers are fully reacted and cured before being formed into pellets or flakes, and are therefore inert. Any slight trace of free isocyanate which might happen to be in the materials is driven off when the materials are heated and extruded. The thermoplastic polyurethanes have been found to produce no change in the flavor of beer stored in bottles closed with the bottle crown of the invention, either by extraction of materials from the polymers or by absorption of flavorants from the beer. Because the thermoplastic polyurethane develops a memory when it is melted and cooled, it tends to retain its shape and returns to it, even after being compressed. It therefore has superior sealing capability. The thermoplastic polyurethane is known for its adhesive qualities, and adheres tenaciously to the metal crown shell, but the cooled polymer does not stick to the glass bottle.

Preferably, the polyurethane liner has a hardness on the order of Shore 60A to 75D, most preferably in the range of 60A to 100A. The polyurethane should not be tacky at normal temperatures (under 100° F.). For convenience in forming the liner it should have a melting point below about 450° F. (235° C.). Both polyether and polyester polyurethanes are useful, and blends of these types are particularly desirable to impart the high degree of hydrolytic stability of the polyether polyurethane and the gas impermeability of the polyester polyurethane.

Either aromatic or aliphatic polyurethanes may be utilized as the liner.

In the method of the invention, a completely reacted thermoplastic polyurethane is melted and applied to the inside of a bottle crown shell to form a liner. The polyurethane is cooled. The cap is then applied to a container. The container is preferably a beer bottle, but the invention may also be used with other containers filled with other materials, for example other beverages such as carbonated soft drinks or wine.

Preferably, the thermoplastic polyurethane liner is applied as a film, and is not foamed or blown in any way.

Other aspects of the invention will be better understood in view of the following description of the preferred embodiment and the appended claims.

DESCRIPTION OF THE PREFERRED EMBODIMENT

Figure 1:
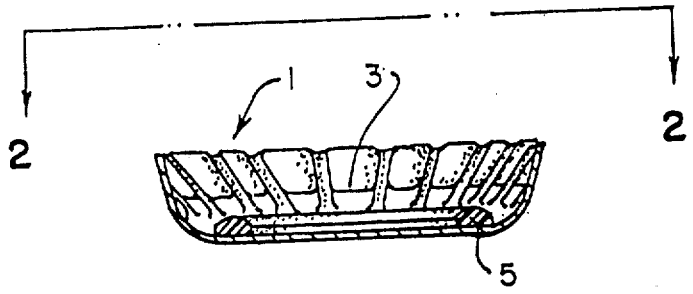
FIG. 1 is a view in cross section of a bottle crown cap having a thermoplastic polyurethane liner in accordance with the present invention.

Referring to the drawings, reference numeral 1 indicates a bottle crown cap in accordance with the present invention. The crown 1 includes a shell 3, made of steel, and a liner 5 made of a thermoplastic polyurethane elastomer. An example of a suitable polyurethane is a commercially available material sold under the trademark Q-THANE PN-03 by K. J. Quinn & Co., Inc. of Malden, Massachusetts. This material is a thermoplastic aliphatic polyurethane and is described in a brochure published by K. J. Quinn & Co. entitled "Introduction and General Information to Q-THANE Thermoplastic Polyurethane Resins."

Other preferred thermoplastic polyurethane resins include a variety of extrusion grade thermoplstic polyurethane elastomers. Q-THANE resins, such as Q-THANE p-455, all sold by K. J. Quinn & Co., may be used. Extrusion grade resins sold under the name Pellethane by the Upjohn Company are described in Upjohn's "Pellethane Processing Guide" and in "DSG Reports" 16, 17 and 20. Examples of these resins are Pellethane 2102-80AE and Pellethane 2103-80PF. Extrusion grade resins sold under the name LIBERAN by Nippon Elastollan Industries Ltd., Tokyo, Japan may also be used. These polymers are described in a brochure entitled "Thermoplastic Polyurethane LIBERAN." Examples of suitable materials are LIBERAN E380 and E-390. These products, as a group, cover a wide range of chemical compositions and a range of hardnesses from Shore 60A to 75D. The extrusion grade materials have a hardness of from Shore 60A to 100A. Aromatic and aliphatic polyurethanes, of both the polyester and polyether types, are included.

EXAMPLE 1

A steel bottle crown shell 3 is cleaned and degreased in accordance with good manufacturing practice. The shell B is placed at the outlet of an extruder to which is added Q-THANE PN-03 in flake form. The flake material is dried in accordance with good manufacturing practice. The extruder has a barrel temperature of 390°–410° F. (200°–210° C.), sufficient to melt the thermoplastic polyurethane polymer. The melted polymer is applied as a ring to the inside of the shell to a thickness of about 10 mils, to form a liner 5. The polymer is allowed to cool to room temperature. The cap 1 is then placed on a filled beer bottle. Maximum strength is obtained if the cap is maintained at about 110° C. for ten hours prior to cooling. This period of elevated heat is not, however, essential to proper functioning of the cap 1.

EXAMPLE 2

A thin sheet of Q-THANE PN-03 thermoplastic polyurethane is extruded as in the preceding example. A ¾ inch square of the material is placed in a beer bottle, and the bottle is filled on conventional filling equipment, crowned, and pasteurized. The bottles were stored for two weeks at 85° F., then cooled and opened. A panel of tasters could detect no flavor change. The square of material was analyzed and found to have extracted no significant flavorants from the beer. By way of comparison, the best previously known crown liner material also produced no detectable flavor change and extracted no significant flavorants from the beer. The amount of flavorants extracted by the thermoplastic polyurethane, however, was half that extracted by the prior art material.

The bottle of Example 1 showed excellent characteristics in standard stack tests and leak tests.

Numerous variations in the container closure and method of the present invention, within the scope of the appended claims, will occur to those skilled in the art in light of the foregoing disclosure. Merely by way of example, the shell 3 may be made of other metals or of other materials such as rigid plastics which have the required strength characteristics. The thermoplastic polyurethane may be applied by different methods. These variations are merely illustrative.

I claim:

1. In a beer bottle filled with beer and closed with a bottle crown comprising a shell and a liner, the improvement wherein the liner is formed of a completely reacted thermoplastic polyurethane elastomer.

2. The improvement of claim 1 wherein the liner has a Shore hardness of from about 60A to about 100A.

3. The improvement of claim 2 wherein the polyurethane elastomer is an extrusion grade polyurethane.

4. The improvement of claim 2 wherein the polyurethane elastomer comprises a polyether polyurethane.

5. The improvement of claim 2 wherein the polyurethane elastomer comprises a polyester polyurethane.

6. The method of making a beer bottle crown and capping a beer bottle with it, the method comprising melting a completely reacted thermoplastic polyurethane, applying the melted polyurethane to the inside of a bottle crown to form a liner, thereafter cooling the polyurethane, and thereafter applying the crown to a bottle filled with beer.

7. The method of claim 6, wherein the thermoplastic polyurethane is an extrusion grade polyurethane, and wherein the step of melting the polyurethane includes placing the polyurethane in an extruder.

8. A method of sealing a beer bottle without influencing the flavor of beer contained within the bottle, said method comprising melting a completely reacted thermoplastic polyurethane, applying the melted fully reacted polyurethane to the inside of a bottle crown shell to form a liner, thereafter cooling the polyurethane, thereafter filling the bottle with beer, and thereafter applying the crown to the bottle to seal the beer into the bottle.

9. The method of claim 8 wherein the fully reacted polyurethane is a polyester polyurethane having a Shore hardness of from 60A to 100A.

* * * * *

PRINTER'S FILM LINE

UNITED STATES PATENT AND TRADEMARK OFFICE

CERTIFICATE OF CORRECTION

PATENT NO. : 4,968,514

DATED : November 6, 1990

INVENTOR(S) : David L. Forbes

It is certified that error appears in the above—identified patent and that said Letters Patent is hereby corrected as shown below:

Cover sheet after "9 claims," cancel "No Drawings" and substitute ---3 Drawing Figures---.

The drawing is attached hereto.

The title page should be deleted to appear as per attached title page.

Figure 2:
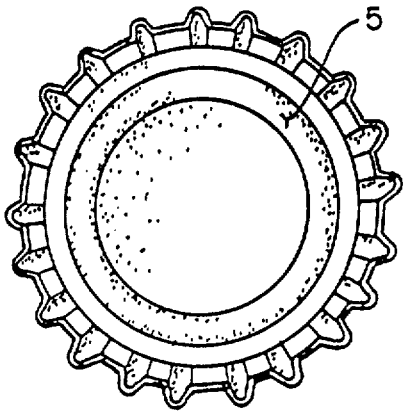
FIG. 2 is a plan view of the crown cap of FIG. 1.
Figure 3:
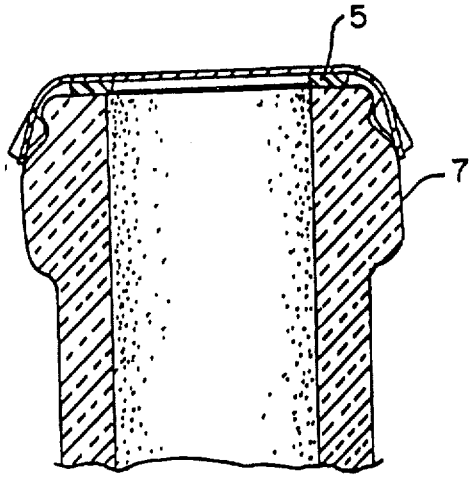
FIG. 3 is a view in cross section of the crown cap of FIGS. 1 and 2 applied to a bottle.

The sheet of drawing consisting of figures 1-3 should be added as per attached sheet.

Signed and Sealed this

Twenty-ninth Day of September, 1992

*Attest:*

DOUGLAS B. COMER

*Attesting Officer*

*Acting Commissioner of Patents and Trademarks*

United States Patent [19]

Forbes

[11] Patent Number: 4,968,514

[45] Date of Patent: Nov. 6, 1990

[54] BEER BOTTLE WITH FULLY REACTED THERMOPLASTIC POLYURETHANE CROWN CAPLINER

[75] Inventor: David L. Forbes, Chesterfield, Mo.

[73] Assignee: Forbes Polytech, Inc., Chesterfield, Mo.

[21] Appl. No.: 921,801

[22] Filed: Oct. 20, 1986

Related U.S. Application Data

[63] Continuation of Ser. No. 680,653, Dec. 11, 1984, abandoned.

[51] Int. Cl.[5] ..... B65D 41/20

[52] U.S. Cl. ..... 426/106; 426/397; 426/131; 215/341; 215/352; 215/328

[58] Field of Search ..... 426/106, 397; 215/341, 215/352, 328, DIG. 2, 348, 349

[56] References Cited

U.S. PATENT DOCUMENTS

| | | | |
|---|---|---|---|
| 2,327,454 | 8/1943 | Punte | 215/328 |
| 2,327,455 | 8/1943 | Punte | 215/328 |
| 3,270,904 | 9/1966 | Foster et al. | 215/346 |
| 3,406,854 | 10/1968 | Testa | 215/352 |
| 3,442,411 | 5/1969 | Mahoney | 215/40 |
| 3,446,380 | 5/1969 | Everett | 215/328 |
| 3,497,098 | 2/1970 | Myer | 215/328 |
| 3,520,436 | 7/1970 | Vercillo | 215/348 |
| 3,547,746 | 12/1970 | Gwinner . | |
| 3,563,402 | 2/1971 | Arnold | 215/341 |
| 3,695,477 | 10/1972 | Edmonston et al. | 215/341 |
| 3,799,380 | 3/1974 | Hashimoto et al. | 215/40 |
| 4,093,098 | 6/1978 | Wszolek | 215/349 |
| 4,128,185 | 12/1978 | Wszolek | 215/349 |
| 4,527,705 | 7/1985 | Prades | 215/341 |

FOREIGN PATENT DOCUMENTS

| | | | |
|---|---|---|---|
| 600346 | 6/1960 | Canada | 215/341 |

OTHER PUBLICATIONS

Hardwick, W. A., Packaging Materials and Beer Quality in Beer Packaging: A Manual for the Brewing and Beverage Industries (1982).

Kirk-Othmer, Encyclopedia of Chemical Technology, 3d Edition, vol. 8, pp. 626–640, vol. 10, pp. 216–246, vol. 23, pp. 576–608, no date given.

K. J. Quinn & Co., Inc., Introduction and General Information to Q-Thane Thermoplastic Polyurethane Resins, no date given.

Upjohn Company, Pellethane Processing Guide, no date given.

Upjohn Company, DSG Reports 16, 17 and 20, no date given.

Nippon Elastollan Industries Ltd., Thermoplastic Polyurethane Liberan, no date given.

*Primary Examiner*—Steven Weinstein

*Attorney, Agent, or Firm*—Polster, Polster and Lucchesi

[57] ABSTRACT

A bottle crown cap, particularly for beer bottles, comprising a metal shell and a liner of thermoplastic polyurethane. The liner material is completely reacted, then applied directly to the shell by a hot melt process.

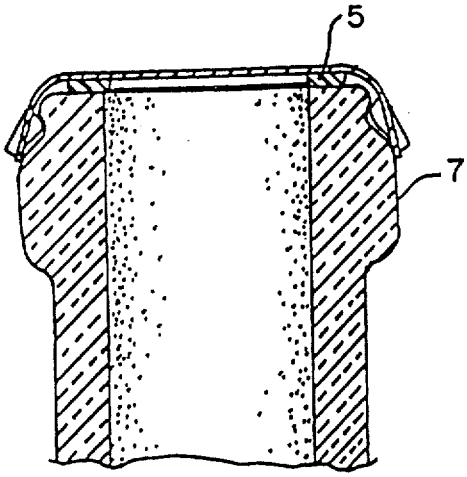

9 Claims, 1 Drawing Sheet